US005447771A

United States Patent [19]

Mills et al.

[11] Patent Number: 5,447,771

[45] Date of Patent: Sep. 5, 1995

[54] FIBER BILOBAL CROSS-SECTIONS AND CARPETS PREPARED THEREFROM HAVING A SILK-LIKE LUSTER AND SOFT HAND

[75] Inventors: Maya D. Mills; Wae-Hai Tung, both of Seaford, Del.

[73] Assignee: E. I. Du Pont de Nemours and Company, Wilmington, Del.

[21] Appl. No.: 85,694

[22] Filed: Jun. 30, 1993

[51] Int. Cl.[6] ..... B32B 3/02; D02G 3/00

[52] U.S. Cl. ..... 428/92; 428/397

[58] Field of Search ..... 428/92, 397

[56] References Cited

U.S. PATENT DOCUMENTS

| | | | |
|---|---|---|---|
| 2,959,839 | 5/1955 | Craig | 28/82 |
| 3,249,669 | 5/1966 | Jamieson | 264/177 |
| 3,508,390 | 9/1968 | Bagnall et al. | 57/140 |
| 4,408,977 | 10/1983 | Phillips | 428/397 |
| 4,416,934 | 11/1983 | Kimura et al. | 428/224 |
| 4,472,477 | 9/1984 | Phillips | 428/397 |
| 4,472,481 | 9/1984 | Snooks, Jr. et al. | 428/397 |
| 4,753,834 | 6/1988 | Braun et al. | 428/74 |
| 4,778,460 | 10/1985 | Braun et al. | 604/380 |
| 4,791,026 | 12/1988 | Yoshimoto et al. | 428/397 |
| 4,892,534 | 12/1988 | Datta et al. | 604/370 |
| 4,954,398 | 9/1990 | Bagrodia et al. | 428/397 |
| 5,108,383 | 4/1992 | Tung | 428/92 |
| 5,124,205 | 6/1992 | Raynolds et al. | 428/373 |
| 5,208,106 | 5/1993 | Tung | 428/92 |
| 5,268,229 | 12/1993 | Phillips et al. | 428/397 |

FOREIGN PATENT DOCUMENTS

| | | | |
|---|---|---|---|
| 2268809 | 11/1987 | Japan | 428/397 |
| 6714466 | 10/1967 | Netherlands | 428/397 |
| 1153543 | 5/1969 | United Kingdom . | |

*Primary Examiner*—George F. Lesmes
*Assistant Examiner*—Terrel Morris

[57] ABSTRACT

The present invention relates to synthetic filaments having a distinctive bilobal cross-sectional shape. The cross-section includes a rectangular-shaped segment, wherein lobes having a curved tip portion extend from each end of the segment. The filaments are especially suitable for making carpets which exhibit a silk-like luster and have a soft hand.

6 Claims, 2 Drawing Sheets

FIBER BILOBAL CROSS-SECTIONS AND CARPETS PREPARED THEREFROM HAVING A SILK-LIKE LUSTER AND SOFT HAND

BACKGROUND OF THE INVENTION

1. Field of the Invention

The present invention relates to synthetic filaments having a distinctive bilobal cross-sectional shape. The filaments are especially suitable for making carpets which exhibit a silk-like luster and have a soft hand.

2. Description of Related Art

The majority of carpets used in residences are referred to as cut-pile carpets. In such carpets, heat-set, ply-twisted, pile yarn is inserted into a backing material as loops which are then cut to form vertical tufts. The tufts are then evenly sheared to a desired height which is typically about 0.4 to 0.7 inches.

Today, there are numerous cut-pile carpet styles available, depending upon where the carpet is to be installed. For instance, in areas where there is a high level of traffic, such as hallways and stairs, frieze-type carpets are often used. These carpets are made from ply-twisted pile yarns having a high degree of twist. Generally, such carpets have a firm, dense "hand" and show good durability. By the term, "hand", it is meant the tactile qualities of the carpet such as softness, firmness, elasticity and other qualities perceived by touch. In living rooms, textured saxony-type carpets having good durability, as well as a plusher, more luxurious hand are often used.

For bathrooms, there is a particular need for carpets which have a soft and comfortable texture. As used herein, the term "carpet" includes floor coverings having pile yarns and a backing system as well as rugs which may or may not have a secondary backing. It is also important that such carpets have good "washfastness" since they are subjected to frequent washing and drying. By the term "washfastness" as used herein, it is meant the resistance of the dyed carpet to loss of color during laundering.

Those skilled in the art have considered different ways for preparing carpets having a softer, more comfortable hand. For instance, it is known to use multifilament yarns having a denier per filament (dpf) of about 4.5 dpf in order to obtain such an effect. However, these finer dpf yarns are more difficult to manufacture than coarse dpf yarns, especially in bulked continuous filament (BCF) yarn-making operations. This translates into higher total production costs for the finished carpet. Moreover, finer dpf yarns tend to have poor washfastness and newness retention due to the increased surface area of the filaments.

In addition, Jamieson, U.S. Pat. No. 3,249,669, describes making fabrics from polyester multifilament yarn bundles, wherein the filaments have different cross-section shapes. Thus, filaments having round cross-sections are combined with filaments having Y-shaped cross-sections. The fabrics are described as having more bulk and a "pleasing hand" versus yarns of homogeneous filament cross-sections.

Kimura et al., U.S. Pat. No. 4,416,934 describes a woven or knitted polyester multifilament fabric having a silk-like appearance and touch. The fabric is composed of polyester multifilament yarns each containing filaments of an irregular cross-sectional profile, e.g., trilobal, star-shaped, C-shaped, L-shaped, or V-shaped cross-sections.

In Bagnall, U.S. Pat. No. 3,508,390, filaments having a Y-shaped cross-section are described. The filaments may be prepared from synthetic polymers, such as polyamides and polyesters, and may be used in floor covering materials. Fabrics prepared from such filaments are described as having excellent dyeability and may have a silk appearance and dry, soft hand depending upon its intended use.

Now, in accordance with the present invention, there are provided filaments having distinctive bilobal cross-sections. Yarn bundles containing said filaments may be used to prepare carpets having good bulk and a soft hand. The carpets also exhibit a silk-like luster with low glitter and good color depth By the term "luster" it is meant the overall glow of the carpet from reflected light By the term "glitter" it is meant the specks of light perceived on the carpet when intense light is directed at the carpet. This is due to minute fiber sections acting as mirrors or reflecting prisms. Carpets are often referred to as having a bright or dull luster, but both types of carpets may have a high degree of glitter. "Color depth" refers to the color's degree of intensity. It has further been found that the carpets of this invention also demonstrate good washfastness.

SUMMARY OF THE INVENTION

The present invention relates to new filaments having a distinctive bilobal cross-sectional shape. The filaments are composed of a thermoplastic polymer and are characterized by a cross-section having a substantially flat sided rectangular-shaped central segment. Arms, or lobes, having a curved tip portion extend from each end of the central segment in such a manner that an angle of 105 to 165 degrees is formed between each of the arms and the central segment.

Suitable fiber-forming polymers include polyamides, such as nylon 6,6 and nylon 6, polyesters, and polyolefins. The filaments may be used to make bulked continuous filament yarns and staple fiber which are suitable for carpets. Preferably, the total yarn denier is about 1000 to 1200, and the denier per filament is about 6 to 12. Carpets prepared from such yarns exhibit a silk-like luster and have a soft, comfortable hand.

The invention also includes spinnerets for making such filaments. The spinnerets include a plate having upper and lower surfaces connected by a segmented capillary. The segmented capillary includes a central rectangular-shaped slot and two radial slots. Each radial slot is connected to an opposite end of the central slot at an angle of 105 to 165 degrees.

DETAILED DESCRIPTION OF THE INVENTION

The filaments of this invention are generally prepared by spinning molten polymer or polymer solutions through spinneret capillaries which are designed to provide specific fiber cross-sections.

The filaments may be prepared from synthetic, thermoplastic polymers which are melt-spinnable. These polymers include, for example, polyolefins such as polypropylene, polyamides such as polyhexamethylene adipamide (nylon 6,6) and polycaprolactam (nylon 6), and polyesters such as polyethylene terephthalate. Copolymers, terpolymers, and melt blends of such polymers are also suitable. For instance, copolyamides containing at least 80% by weight of hexamethyleneadipamide units and one or more different amide units made from amide-forming moieties such as 2-methyl-pentamethylenediamine (MPMD), caprolactam, dodecanedioic acid, isophthalic acid, etc. may be used. Polymers which form solutions, such as polyacrylonitrile, may also be used. These polymer solutions are dry-spun into filaments.

Generally, in a nylon filament-forming process, the molten polymer is extruded through a spinneret into a quenching medium, where the polymer cools and solidifies to form filaments. Typically, the molten polymer is extruded into a quench chimney where chilled air is blown against the newly formed hot filaments. The filaments are pulled through the quench zone by means of a feed roll and treated with a spin-draw finish from a finish applicator. The filaments are then passed over heated draw rolls. Subsequently, the filaments may be crimped and cut into short lengths to make staple fiber, or bulked to make bulked continuous filaments (BCF). Crimping of the yarn may be conducted by such techniques as gear-crimping or stuffer-box crimping. Hot air jet-bulking methods, as described in Breen and Lauterbach, U.S. Pat. No. 3,186,155, may be employed to bulk the yarn.

It is recognized that the specific spinning conditions, e.g., viscosity, rate of extrusion, quenching, etc. will vary depending upon the polymer used. The polymer spinning dopes may also contain conventional additives, such as delustrants, antioxidants, dyes, pigments, antistatic agents, ultraviolet stabilizers, etc.

The resulting singles yarn may be ply-twisted together on a cable twister. The ply-twisted yarn is then subjected to a heat-setting operation to set the twist and bulk in the yarn. Such operations include a Superba® method using saturated steam, or a Suessen method using dry heat. The yarns may then be tufted into carpet backings by techniques known in the trade and the carpet is subjected to dyeing and other finishing steps including stain-resist and fluorochemical treatment.

Figure 3:
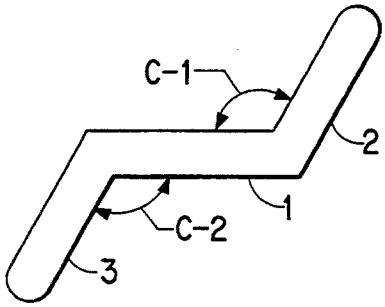
FIG. 3 is a face view of a spinneret capillary of the present invention, comprising three connecting rectangular-shaped slots.

Referring to FIG. 3, an example of a suitable spinneret capillary for forming filaments of this invention is illustrated.

Figure 4:
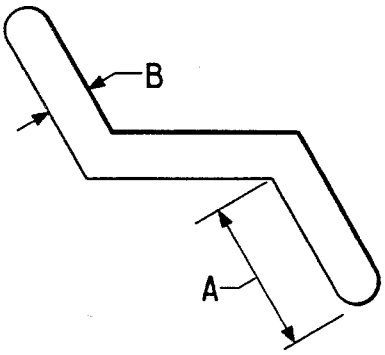
FIG. 4 is a face view of a spinneret capillary of the present invention, comprising three connecting rectangular-shaped slots.

The capillary includes a central rectangular-shaped slot (1) which is connected at each end to radial slots (2) and (3). The angles formed between the central slot and the connecting radial slots (C-1) and (C-2) are in the range of about 105 to 165 degrees. Referring to FIG. 4, the slots typically have a length (A) of about 0.005 to 0.050 inches, and a width (B) of about 0.001 to 0.015 inches.

The dimensions for each slot are further defined by the following ratio:

$$1.5 < A1/B1 < 10$$

where,

A1 = length of a slot

B1 = width of the slot.

Generally, the spinneret capillary should have the foregoing dimensions in order that filaments of this invention may be prepared. However, it is understood that specific dimensions and ratios, within the above ranges, may vary depending upon such factors as polymer type, viscosity, and quench medium. High viscosity polymers and water quench spinning require lower slot length to width ratios, than low viscosity polymers and air quench spinning. It is also recognized that the shape of the slots may be modified, e.g., as shown in FIG. 3, where the tip portion of the radial slots is slightly curved. Preferably, each of the radial slots is substantially the same size and shape.

Figure 3A:
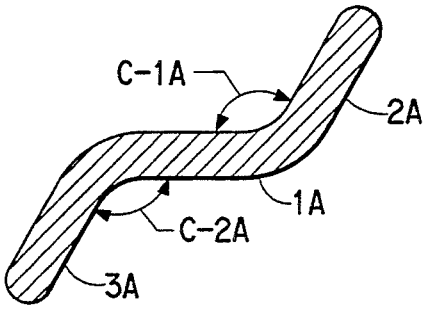
FIG. 3A is a cross-sectional view of a filament spun through capillaries of the type shown in FIG. 3.

The extruded stream of polymer flows through the specifically designed capillary to produce a corresponding filament, as shown, for example in FIG. 3A. It is important that the polymer stream remains intact as a single homogeneous stream and does not separate into multiple streams as it passes through the slots of the spinneret capillary. This provides for filaments having the desired cross-section, as well as good bulk.

In contrast, techniques for producing ribbon-like filaments, as described in Craig, U.S. Pat. No. 2,959,839 and the aforementioned Jamieson, U.S. Pat. No. 3,249,669 involve feeding multiple streams of polymer through circular orifices in the spinneret capillary. The different polymer streams then fuse together after passing through the capillary. With such methods, it is often difficult to obtain a specific cross-section, because the degree of polymer coalescence is so dependent upon such factors as polymer viscosity, polymer temperature, and spacing of the orifices. Secondly, the streams tend to fuse together so poorly that the resulting filaments tend to separate and fibrillate during texturing or under normal wear conditions, giving the carpets a fuzzy surface.

As shown in FIG. 3A, the resulting filaments of this invention are characterized by a cross-section having a substantially flat sided rectangular-shaped central segment (1A). Arms, or lobes, (2A) and (3A) having curved tip portions extend from each end of the central segment in opposite directions. Preferably, the two extending arms are substantially symmetrical.

Figure 4A:
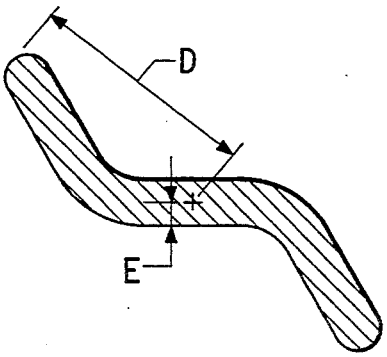
FIG. 4A is a cross-sectional view of a filament spun through capillaries of the type shown in FIG. 4.

More particularly, the arms are connected to the central segment in such a manner that an angle of about 105 to 165 degrees is formed between each arm and the central segment (C-1A) and (C-2A). This provides for a distinctive bilobal "S or Z-like) cross-sectional shape in the filament. It is important that the filaments not have a cross-section with a sharp zig-zag configuration. In carpets containing such filaments, there is a tendency for the lobes of adjacent filaments to interlock with each other resulting in a harsher, more rigid hand with less bulk. With the filaments of this invention, the lobes freely intermingle with each other due to their curved nature. Preferably, an angle of greater than 120 degrees is formed between each arm and the central segment. It is also important that the lobes and central portion of the filament cross-section be substantially flat-sided in order for the filament to have good anti-soiling properties. If the filament's periphery has a high amount of indentations and bulges, areas are created where dirt may become entrapped, and soiling may be more visible in the resulting carpet. In addition, the distance from the central point of the filament to the tip of a lobe (D) should be at least two times (2×) greater than the distance from the central point to the edge of central segment (E), as shown in FIG. 4A. This also ensures that the filament lobes will freely pass over each other, thereby giving the carpet a soft and comfortable hand.

The filaments are generally uniform in cross-section along their length and may be used for several different applications, including carpet, textile, or non-woven uses. For carpet applications, the filaments may be used to manufacture bulked continuous filament (BCF) yarns or staple fiber, as discussed above. The filaments of this invention may be blended with each other or with filaments of other cross-sections. Preferably, the yarn comprises a blend of 40 to 60 percent by weight of filaments having an S-like shaped cross-section and 60 to 40 percent of filaments having a Z-like shaped cross-section By the term "S-like shaped" it is meant a cross-section as shown in FIG. 4A. By the term "Z-like shaped" it is meant a cross-section as shown in FIG. 3A Generally, the carpet yarn will have a denier of at least 500, and preferably the denier will be 1000 to 1200. The denier per filament (dpf) is typically 3 to 30, and preferably, the dpf is in the range of 6 to 12. Carpets prepared from such yarns have good bulk and a soft hand. The carpets have a silk-like luster with low glitter and demonstrate good washfastness. The carpets are especially suitable for use as bath rugs.

In one preferred carpet construction, the carpet comprises a mixture by weight of 20 to 80% multifilament yarns containing trilobal filament cross-sections and 80 to 20% multifilament yarns containing a blend of Z-like and S-like filament cross-sections. When such a carpet is dyed to a single color, a unique multi-dyed appearance is created due to the different filament cross-sections in the carpet. The S-like and Z-like filament cross-sections will tend to have greater color depth (a darker shade), while the trilobal filament cross-sections will tend to have less color depth. In the past, such multi-dyed effects were typically obtained by modifying the composition of the fiber-forming polymer.

The present invention is further illustrated by the following examples, but these examples should not be construed as limiting the scope of the invention.

TESTING METHODS

Carpet Glitter, Hand, and Bulk Ratings

The degrees of glitter, bulk, and hand for different cut-pile carpet samples were compared in a side-by-side comparison without knowledge of which carpets were made with which yarns. The carpets were examined by a panel of people familiar with carpet construction and surface texture. The test carpet samples were given ratings of low, medium and high in the categories of glitter and bulk. For hand, the carpets were rated harsh, medium, or soft.

Washfastness

The carpet samples were washed in a washing machine with hot water and Tide® detergent (0.5 g/liter). The temperature of the wash bath was 100° F. and the pH was 9.5. The samples were then dried with hot air. After 20 washing and drying cycles, the tested samples were compared with a control carpet sample which was not subjected to washing. The test and control samples were assessed by a panel of people familiar with carpet dyeing. Carpet samples with no noticeable change in color depth or shade were given a rating of 5. Carpet samples having substantially a complete loss of color were given a rating of 1.

Relative Viscosity

The relative viscosity (RV) of nylon 6,6 was measured by dissolving 5.5 grams of nylon 6,6 polymer in 50 cc of formic acid. The RV is the ratio of the absolute viscosity of the nylon 6,6/formic acid solution to the absolute viscosity of the formic acid. Both absolute viscosities were measured at 25° C.

Color Depth

This method is used to determine the color depth, i.e., color intensity, of the sample carpets. The samples were tested using a Hunterlab 025 Color/Difference Meter, available from Hunter Associates Laboratory, Fairfax, Va. This instrument measured the "L" (total reflectance) values of the samples. The "L" value is a measure of lightness which varies from 100 for perfectly white regions to 0 for black regions. The samples were placed into the sample cradle and passed across the viewing port of the colorimeter. The "L" values were registered on the digital readout.

EXAMPLES

Examples 1–3

In the following examples, nylon 6,6 filaments having various cross-sections were produced. The nylon 6,6 filaments were spun from different spinnerets. Each spinneret had 160 capillaries of a specific design, as shown in FIGS. 1–4.

The nylon 6,6 polymer used for all of the examples was a bright polymer. The polymer spin dope did not contain any delustrant and had a relative viscosity (RV) of 72+/−3 units. The polymer temperature before the spinning pack was controlled at about 288+/−1° C. and spinning throughput was 70 pounds per hour. The polymer was extruded through the different spinnerets and divided into two 80 filament segments. The molten fibers were then rapidly quenched in a chimney, where cooling air at 9° C. was blown past the filaments at 300 cubic feet per minute (0.236 cubic m/sec). The filaments were pulled by a feed roll rotating at a surface speed of 800 yd./min (732 m/min) through the quench zone and then were coated with a lubricant for drawing and crimping. The coated yarns were drawn at 2197 yds/min (2.75×draw ratio) using a pair of heated (175° C.) draw rolls. The yarns were then forwarded into a dual-impingement bulking jet (225° C. hot air), similar to that described in Coon, U.S. Pat. No. 3,525,134 to form two 1200 denier, 15 denier per filament (dpf) yarns.

The spun, drawn, and crimped bulked continuous filament (BCF) yarns were cable twisted to 4.0×4.0 turns per inch (tpi) on a cable twister and heat-set on a Superba® heat-setting machine at the standard process conditions for nylon 6,6 BCF yarns. The test yarns were then tufted into 40 oz/yd., ⅝ inch pile height carpets on a ⅛ inch gauge cut-pile tufting machine. The tufted carpets were dyed to a forest green color in a Beck dyer for about one hour at a temperature of about 210° F. The carpet aesthetics were assessed by a panel, as discussed in the foregoing Testing Methods, and the results are reported below in Table I.

Example 1 (Comparative)

Figure 1:
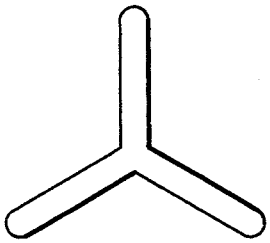
FIG.1 (PRIOR ART)
FIG. 1 is a face view of a trilobal spinneret capillary of the prior art.
Figure 1A:
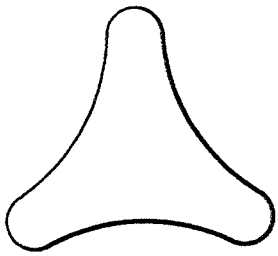
FIG.1A (PRIOR ART)
FIG. 1A is a cross-sectional view of a filament spun through capillaries of the type shown in FIG. 1.

Multifilament yarns consisting only of trilobal filament cross-sections, as shown in FIG. 1A, were made using the above-described process. The filaments were spun through spinneret capillaries, as shown in FIG. 1, having three integrally joined arms (lobes) which were essentially symmetrical. The arms had a width of 0.008 inches and a length of 0.017 inches. The resulting filaments had a modification ratio (MR) of 1.7.

Example 2 (Comparative)

Figure 2:
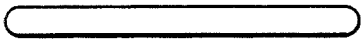
FIG.2 (PRIOR ART)
FIG. 2 is a face view of a ribbon spinneret capillary of the prior art.
Figure 2A:
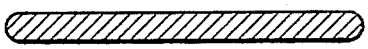
FIG.2A (PRIOR ART)
FIG. 2A is a cross-sectional view of a filament spun through capillaries of the type shown in FIG. 2.

Multifilament yarns consisting only of flat ribbon filament cross-sections, as shown in FIG. 2A, were made using the above described process. The filaments were spun through spinneret capillaries, as shown in FIG. 2, having a slot length of 0.081 inches and a width of 0.009 inches.

Example 3

Multifilament yarns of this invention having a 50/50% by weight mixture of the filament cross-sections shown in FIG. 3A and 4A were made using the above-described process. The respective filaments were spun through spinneret capillaries, as shown in FIG. 3 and 4. Both capillaries consisted of three equal dimensional slots of 0.027 inches in length and 0.009 inches in width. The angles formed between the slots at C-1 was 120 degrees, while the angle formed at C-2 was 135 degrees.

TABLE I

| Example | Cross-section | Hand | Glitter | Bulk | *Color Depth |
|---|---|---|---|---|---|
| 1 (Comparative) | 1.7 MR Trilobal | Harsh | High | High | 29.56 |
| 2 (Comparative) | Flat Ribbon | Soft | Low | Low | 17.62 |
| 3 | Current Invention | Soft | Low | Medium to High | 16.84 |

*L values — lower values correspond to a deeper colored appearance

Example 4 and Comparative Example 5

Nylon 6,6 bulked continuous multifilament yarns were produced using a spinning process similar to the process described in Examples 1 to 3. The yarn in Example 4 was a 1015 denier, 6.3 dpf yarn having a 50/50% blend of the filament cross-sections shown in FIGS. 3A and 4A. The yarn in Comparative Example 5 was a 1005 denier, 4.5 dpf yarn having 2.5 MR trilobal filament cross-sections. Both yarn samples were cable twisted at 4×4 tpi, heatset at 270° F. on a Superba® heatset machine, tufted into 46 oz/sq. yd. bath rugs on a 3/16 gauge (2 ends per needle) machine and dyed in a Beck dyer to a cranberry red color for about one hour at a temperature of about 210° F. The test rugs were assessed by a panel for luster and hand, as discussed above. The rugs were also tested for washfastness, as described above. The test results are summarized below in Table II.

Example 6

Two nylon bulked continuous multifilament yarn samples having different filament cross-sections were produced using a spinning process similar to the process described in above Examples 1–3. One sample was an 1105 denier, 7 dpf yarn having a 50/50% blend of the filament cross-sections shown in FIGS. 3A and 4A. The other sample was the yarn described in Comparative Example 5 (1005 denier, 4.5 dpf, 2.5 MR trilobal filament cross-sections). Both yarn samples were independently cable twisted at 4×4 tpi and heat-set in an autoclave at 270° F. Both yarn types were then tufted into a backing on a 3/16 gauge machine (one end of each yarn per needle) to form a 45 oz/sq.yd. carpet. The finished carpet contained a mixture of 50% by weight of the yarns having trilobal filament cross-sections and 50% of the yarns containing the blend of Z-like and S-like filament cross-sections. The finished carpet was dyed to a Navajo green color. The dyed carpet had a multi-dyed appearance with the 1005 denier yarn (trilobal cross-sections) having a medium green colored appearance, and the 1105 denier yarns (S-like and Z-like cross-sections) having a deep green colored appearance.

TABLE II

| Example | Denier/dpf | Cross-section | Hand | Wash Fastness |
|---|---|---|---|---|
| 4 | 1015/6.3 | Current Invention | Soft | 5 |
| 5 (Comparative) | 1005/4.5 | 2.5 MR Trilobal | Medium | 3 |

We claim:

1. A multifilament yarn, wherein the yarn comprises a blend of 40 to 60 percent by weight of filaments having an S shaped cross-section and 60 to 40 percent having a Z shaped cross-section, wherein the cross-section for each filament comprises a substantially flat sided rectangular-shaped central segment having two opposite ends with a substantially flat sided arm having a curved tip portion extending from each opposite end of the central segment, wherein the width of the central segment and each arm is substantially the same, and the length of the central segment and each arm is substantially the same and wherein the angle formed between the arms and the central segment ranges from 105 degrees to 165 degrees.

2. The multifilament yarn of claim 1, wherein the filaments are bulked continuous filaments comprising a synthetic polymer selected from the group consisting of polyamides, polyester, polyolefins, and polyacrylonitrile.

3. The multifilament yarn of claim 1, wherein the filaments are staple fiber comprising a synthetic polymer selected from the group consisting of polyamides, polyester, polyolefins, and polyacrylonitrile.

4. The multifilament yarn of claim 1, wherein the yarn has a denier of 1000 to 1200 and a denier per filament of 6 to 12.

5. A carpet comprising the multifilament yarns of claim 1 tufted into a support.

6. A carpet comprising a mixture of 20 to 80 percent by weight of the multifilament yarns of claim 1, and 80 to 20 percent of multifilament yarns having filaments with trilobal cross-sections tufted into a support.

* * * * *